US006203148B1

(12) United States Patent
Kishida

(10) Patent No.: US 6,203,148 B1
(45) **Date of Patent: *Mar. 20, 2001**

(54) LIQUID CONTAINER FOR AN INK JET RECORDING APPARATUS

(75) Inventor: Hajime Kishida, Tokyo (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/901,647

(22) Filed: Jul. 28, 1997

(30) Foreign Application Priority Data

Jul. 31, 1996 (JP) ..... 8-202140
Feb. 19, 1997 (JP) ..... 9-035057

(51) Int. Cl.[7] ..... B41J 2/175
(52) U.S. Cl. ..... 347/86
(58) Field of Search ..... 347/20, 40, 43, 347/84, 85, 86, 87, 93

(56) References Cited

U.S. PATENT DOCUMENTS 4,539,569 * 9/1985 Watanabe et al. ..... 347/43
4,771,295 9/1988 Baker et al. ..... 347/87
5,619,238 * 4/1997 Higuma et al. ..... 347/86

FOREIGN PATENT DOCUMENTS 542247 5/1993 (EP) .
624475 11/1994 (EP) .
639462 2/1995 (EP) .
3-288652 * 12/1991 (JP) ..... 347/86
8-192520 7/1996 (JP) .

* cited by examiner

*Primary Examiner*—N. Le
*Assistant Examiner*—Anh T. N. Vo
(74) *Attorney, Agent, or Firm*—Fitzpatrick, Cella, Harper & Scinto

(57) ABSTRACT

A liquid container for an ink jet apparatus requires only one liquid preserving container for a single kind of liquid even when a plurality of ink jet recording elements are used and which can also be expected to improve the printing density and the printing speed. For this purpose, a plurality of liquid supplying portions are provided in a liquid container having a liquid containing portion containing therein a sponge or the like for holding a single kind of liquid, and a liquid supplying port for supplying the liquid to ink jet recording elements.

28 Claims, 6 Drawing Sheets

1
2

1
2

1
2

20
3
2

20
3
2
2a

LIQUID CONTAINER FOR AN INK JET RECORDING APPARATUS

BACKGROUND OF THE INVENTION

1. Field of the Invention

This invention relates to a liquid container for an ink jet apparatus containing therein liquid to be supplied to the recording element of the ink jet apparatus and providing a negative pressure source to the recording element, and particularly to a liquid container for an ink jet apparatus containing a single kind of liquid therein and having a plurality of liquid supply portions disposed therein to introduce the liquid.

2. Related Background Art

The construction of an example of a liquid container for an ink jet apparatus containing therein liquid to be supplied to the recording element (recording head) of the ink jet apparatus and providing a negative pressure source to the recording head is schematically shown in FIGS. 7A, 7B and 7C of the accompanying drawings. FIG. 7A is a partly broken-away side view of the liquid container, FIG. 7B is a bottom view thereof, and FIG. 7C is a front view thereof.

As shown in FIG. 7A, the liquid container 1 is provided with a liquid containing portion 20 and a supply port as a liquid supplying portion provided in a portion of the liquid containing portion 20 for supplying the contained liquid to the recording head of the ink jet apparatus. A liquid holding member 3 for holding the liquid to be supplied to the recording head is contained in the liquid containing portion 20.

The liquid container 1 shown thus has adopted a construction in which a single kind of liquid, e.g. black ink, is held in the liquid holding member 3 and a liquid supplying port 2 is provided for a recording head (e.g. a recording head for black ink) provided in an ink jet apparatus, whereby liquid is supplied at one by one.

There is also an example of the liquid container 1 in which a plurality of liquid containing portions 20 containing therein a plurality of liquids (e.g. cyan ink, magenta ink and yellow ink) are constructed integrally with one another, and again in such construction, only a single liquid supplying port 2 has been disposed for a liquid containing portion 20 containing a single kind of liquid therein.

In the conventional ink jet apparatus, recording has been effected with a single liquid (ink) discharged from a single recording head, but there is conceived a form in which use is made of a plurality of recording heads for discharging a single kind of ink with a view to improve the recording speed and improve the printing density by superposition.

In this case, a liquid container is prepared for each recording head, but the disposition space for the liquid containers need be wide, thus resulting in the bulkiness of the apparatus. Also, to prevent any irregularity from occurring to recorded prints, it is preferable to make the discharge condition uniform for a plurality of recording heads discharging a single kind of ink and it is preferable to exactly adjust the conditions of a plurality of liquid containers supplying the ink to one another, but it is difficult to prepare liquid containers uniform in condition. Further, it is conceivable to cope with the condition by making the ink path leading from the liquid container to the recording head branch off in the course thereof, but according to this, the ink path is liable to become complicated and it is difficult to cope with the condition easily.

SUMMARY OF THE INVENTION

The present invention has been made in view of the above-described situation and an object thereof is to provide a liquid container which can substantially equalize the conditions of ink supply even when use is made of a plurality of recording heads discharging a single kind of ink, and achieves the stable supply of the ink.

It is also an object of the present invention to provide a liquid container which can achieve the saving of the disposition space for the liquid container in the interior of an apparatus.

It is a further object of the present invention to provide a liquid container capable of supplying ink without a supply route for the ink being especially complicated.

It is still a further object of the present invention to provide a liquid container which can contribute to an improvement in printing speed and an improvement in printing density.

To achieve the above objects, the present invention is a liquid container for an ink jet apparatus provided with a liquid containing portion containing a single kind of liquid therein, a supplying portion for directing the liquid outwardly from the liquid containing portion, and an atmosphere communicating portion for communicating the interior of the liquid containing portion with the atmosphere, and enabling the liquid to be supplied from the supplying portion to the recording element of the ink jet apparatus and providing a negative pressure source for the recording element, characterized in that a plurality of the supplying portions are disposed corresponding to a plurality of recording elements for the liquid containing portion so that the liquid can be supplied to the recording elements.

Even when a plurality of recording elements are used, only one liquid container is required for a single kind of liquid (ink or treating liquid). Thereby, the liquid supplied becomes uniform in any one of the recording elements and therefore, the irregularity of the discharging condition of the liquid can be suppressed. Also, the disposition space for the liquid container in the interior of the apparatus can be saved.

A liquid holding member is contained in the liquid containing portion, and a fibrous member is disposed in the supplying portion.

The performance of directing the liquid outwardly from the liquid container can be improved and the more stable performance of supplying the liquid can be achieved. The fibrous member may be in the form of a fiber bundle or the form of a felt material.

The liquid containing portion is divided into a plurality of chambers, which are connected together by a communication opening portion.

Only the liquid can be contained in the liquid container and an improvement in the quantity of contained ink can be achieved.

Also, the liquid containing portion is provided with a first chamber provided with a plurality of the supplying portions and the atmosphere communicating portion and having a liquid holding member contained therein, and a second chamber made into a substantially closed space except a communication opening portion provided for communication with the first chamber, and communicating with the first chamber only through the communication opening and containing therein the liquid to be supplied to the first chamber.

The level of the liquid in the first chamber in which the liquid holding member is contained can be stabilized and the state of the negative pressure level relative to the recording elements can be stabilized. Therefore, stable liquid supply free of the irregularity of characteristic becomes possible to each recording element.

Also, the number of the plurality of supplying portions disposed in the first chamber is two, and the supplying portions are juxtaposed so that the distances thereof from the communication opening portion may be substantially equal to each other.

The distances from the communication opening portion to the liquid supplying portions can be made equal to each other, the flow resistance of the liquid can be uniformized, and the liquid supplying properties can be adjusted to each other in the two supplying portions.

Also, respective ones of the central positions of the two supplying portions are disposed at locations spaced apart from two side walls constituting the liquid containing portion and adjacent to the supplying portions, by a distance obtained by substantially quartering the spacing between the side walls.

The plurality of supplying portions in the liquid containing portion are disposed well-balancedly and therefore, the liquid supplying performance can be equalized irrespective of the supplying portions.

Also, black, cyan, magenta or yellow ink is contained in the liquid container.

Also, treating liquid is contained in the liquid container.

As the treating liquid, mention may be made of one which reacts with ink and improves the fixativeness for a recording medium.

Also, the present invention is a liquid container for an ink jet apparatus provided with a liquid containing portion containing a single kind of liquid therein, a supplying portion for directing the liquid outwardly from the liquid containing portion, and an atmosphere communicating portion for communicating the interior of the liquid containing portion with the atmosphere, and enabling the liquid to be supplied from the supplying portion to the recording element of the ink jet apparatus, and providing a negative pressure source for the recording element, characterized in that the liquid containing portion has a plurality of the supplying portions, and is provided with a first chamber in which the atmosphere communicating portion and a liquid holding member are contained, and a second chamber made into a substantially closed space except a communication opening portion provided for communication with the first chamber, and communicating with the first chamber only through the communication opening and containing therein the liquid to be supplied to the first chamber, the number of the plurality of supplying portions disposed in the first chamber is two, and the supplying portions are juxtaposed so that the distances thereof from the communication opening portion may be substantially equal to each other.

Also, the level of the liquid in the first chamber in which the liquid holding member is contained can be stabilized, and the state of the negative pressure for the recording elements can be stabilized. Therefore, stable liquid supply free of the irregularity of characteristic becomes possible to each recording elements. Also, the plurality of supplying portions in the liquid containing portion are disposed well-balancedly and therefore, the liquid supplying performance can be equalized irrespective of the supplying portions. Further, the disposition space for the liquid container can be saved.

In addition, a simple construction can be intactly adopted without the liquid supply route on the recording element side being complicated and thus, the unnecessary rise of cost can be prevented. Further, stable liquid supply can be achieved, whereby an improvement in printing speed and an improvement in printing density can be well achieved.

DESCRIPTION OF THE PREFERRED EMBODIMENTS

Some embodiments of the present invention will hereinafter be described with reference to the drawings.

(Embodiment 1)

Figures 1A, 1B, 1C, 1D, 1E:
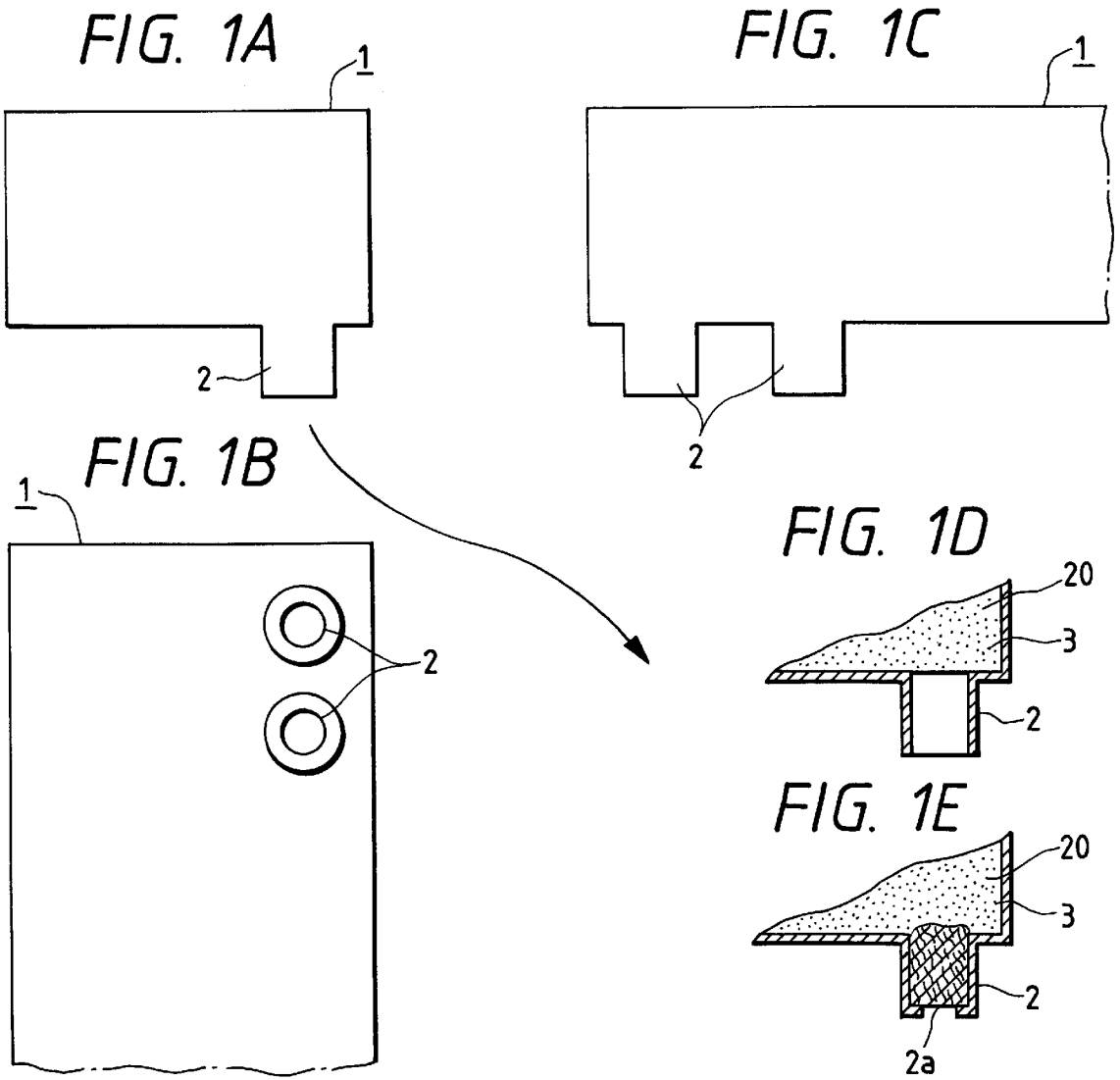
FIGS. 1A, 1B, 1C, 1D and 1E are schematic views of a liquid container having two liquid supplying ports according to Embodiment 1.

FIGS. 1A to 1E show an embodiment of a liquid container according to the present invention, FIGS. 1A, 1B and 1C being views schematically showing the construction of the liquid container, and FIGS. 1D and 1E being cross-sectional views schematically showing the construction of a liquid supplying portion.

In the present embodiment, the construction of the liquid container 1 for supplying liquid (e.g. ink) to two recording elements (recording heads, not shown) for discharging a single kind of liquid is disclosed. As shown in FIGS. 1B and 1C, two liquid supplying portions 2 connected to the two recording heads for supplying the ink are juxtaposed along the two sides of the liquid container 1 containing a single kind of liquid therein.

By providing a plurality of liquid supplying ports 2 in a liquid container 1 containing a single kind of ink therein as described above, the ink is supplied under a common ink supply condition, and the discharge states of the ink in the two recording heads can be stably equalized. Therefore, printing of high quality can be achieved without any irregularity of ink discharge, for example, in high-speed printing to be achieved by the two recording heads. Also, in high-density printing, the printing density can be stably uniformized.

Also, as shown in FIGS. 1D and 1E, a liquid holding member 3 is contained in a liquid containing portion 20. By this liquid holding member 3, the liquid (ink) is stored and held in the liquid containing portion 20, whereby negative pressure for the recording elements (recording heads, not shown) can be created. A continuous porous material such as polyurethane foam or a fibrous material can be used for the liquid holding material can be used for the liquid holding member 3, and it becomes possible to create the aforementioned negative pressure for the recording elements by the capillary force of these materials.

The liquid supplying ports 2 are cylindrical hollow tubes projected outwardly from the liquid containing portion 20, and are connected to the supply pipes of the recording elements, whereby they are joined together and form a liquid supply route. The liquid supplying ports 2 need not always be such cylindrical hollow tubes, but may be formed as simple openings, and can be of any construction which can reliably achieve the joinder with the supply pipes of the recording elements.

The liquid supplying port 2, as shown in FIG. 1E, may have a fibrous member 2*a* such as a felt material made of polypropylene or polyethylene or a fiber bundle member disposed therein. By such a fibrous member 2*a* being disposed, it becomes possible to improve the performance of directing the liquid (ink) outwardly from the liquid containing member 3 in the liquid containing portion 20. Of course, what is disposed in the liquid supplying port 2 is not restricted to the fibrous member, but may be something like a porous member which achieves high compression by the connection thereof to the recording head. Although not shown in FIG. 1, the liquid container 1 has an atmosphere communicating portion for communicating the interior thereof with the atmosphere.

Figure 2C:
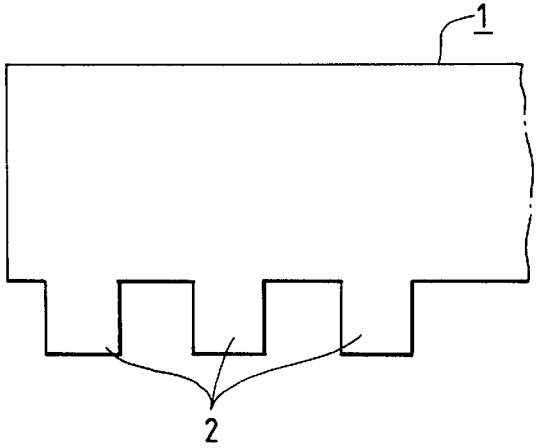
FIGS. 2A, 2B and 2C are views corresponding to FIGS. 1A, 1B and 1C but showing a liquid container having two more liquid supplying ports.
Figure 2A:
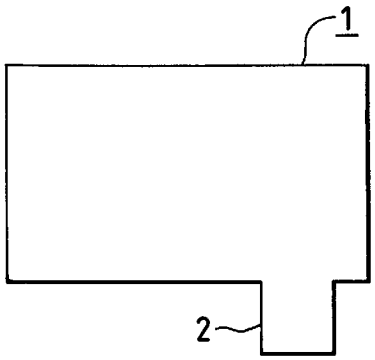
Figure 2B:
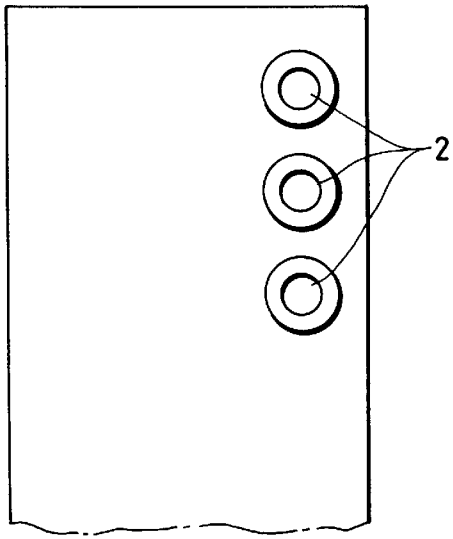

The present embodiment has been shown as a liquid container 1 storing therein a single kind of ink which is provided with two liquid supplying ports 2 connected to two recording heads for discharging the single kind of ink, but alternatively, as shown in FIGS. 2A, 2B and 2C, the liquid container may be of a construction provided with three liquid supplying ports 2 corresponding to three recording heads for discharging a single kind of ink for which the liquid container 1 stores a single kind of ink therein. In FIGS. 2A, 2B and 2C, the same constituents as those in FIGS. 1A to 1E are given the same reference numerals and need not be described.

This embodiment is not restrictive, but of course, the liquid container 1 may be provided with three or more liquid supplying ports 2.

(Embodiment 2)

Figure 3A:
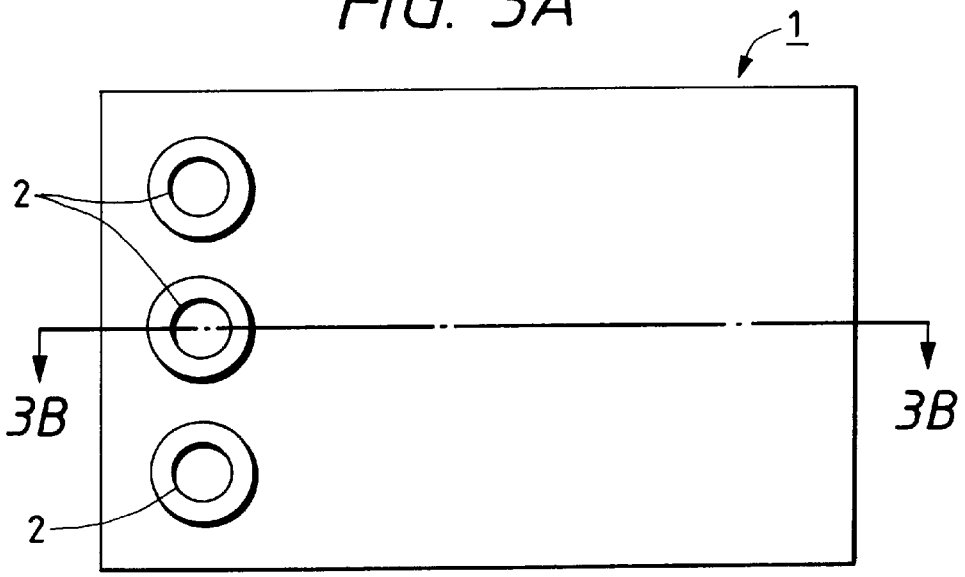
FIGS. 3A and 3B show a liquid container having a plurality of partition walls according to Embodiment 2.
Figure 3B:
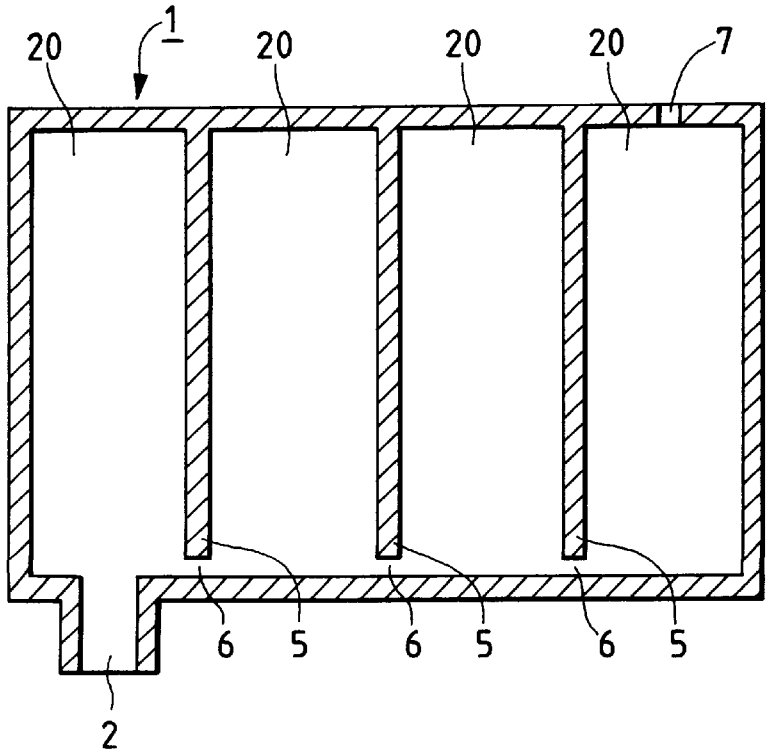

FIGS. 3A and 3B show another embodiment of the present invention.

In this embodiment, as shown in FIG. 3B, the interior of the liquid containing portion 20 is divided into four by partition walls 5, and adjacent portions of the liquid containing portion 20 communicate with one another by minute communicating portions 6 provided between the partition walls 5 and the bottom of the liquid containing portion 20. In this embodiment a porous material or the like is not used as the liquid holding member 3, but the minute communicating portions 6 function as a creating source for negative pressure for the recording head (not shown). Thereby, the quantity per volume of the liquid which can be contained in the liquid container 1 can be increased.

Also, as shown in FIG. 3A, in the present embodiment, three liquid supplying portions 2 are juxtaposed in a direction intersecting the both sides of the liquid container 1.

(Embodiment 3)

Figure 4A:
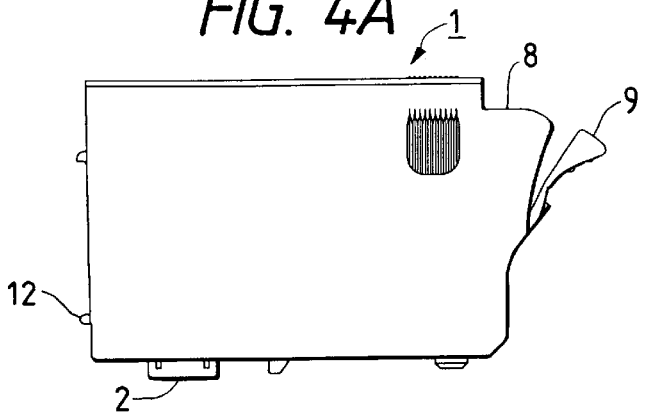
FIGS. 4A, 4B, 4C, 4D, 4E and 4F show a liquid container according to Embodiment 3.
Figure 4B:
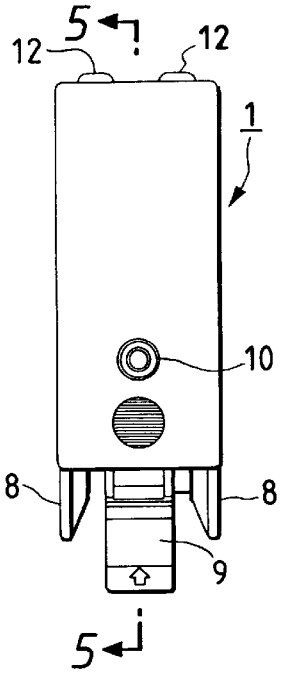
Figure 4C:
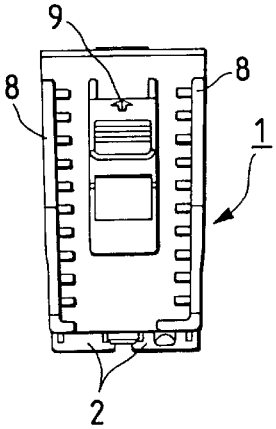
Figure 4E:
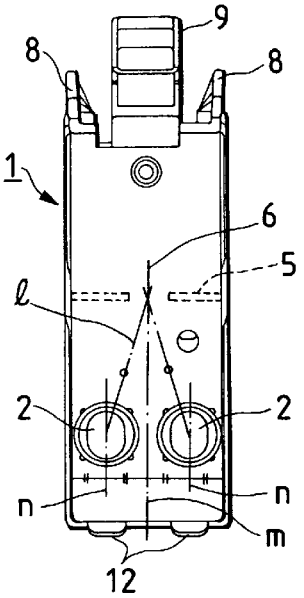
Figure 4D:
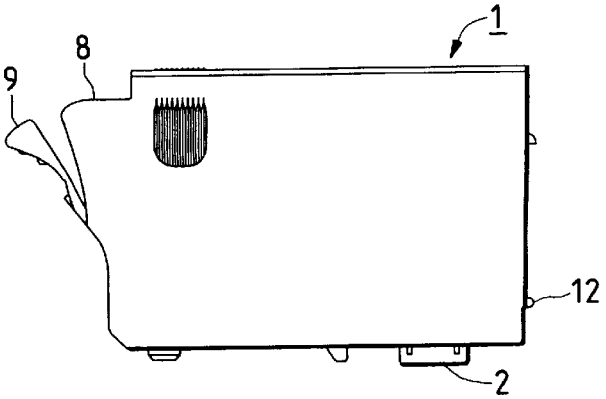
Figure 4F:
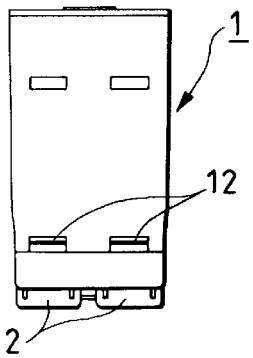
Figure 5:
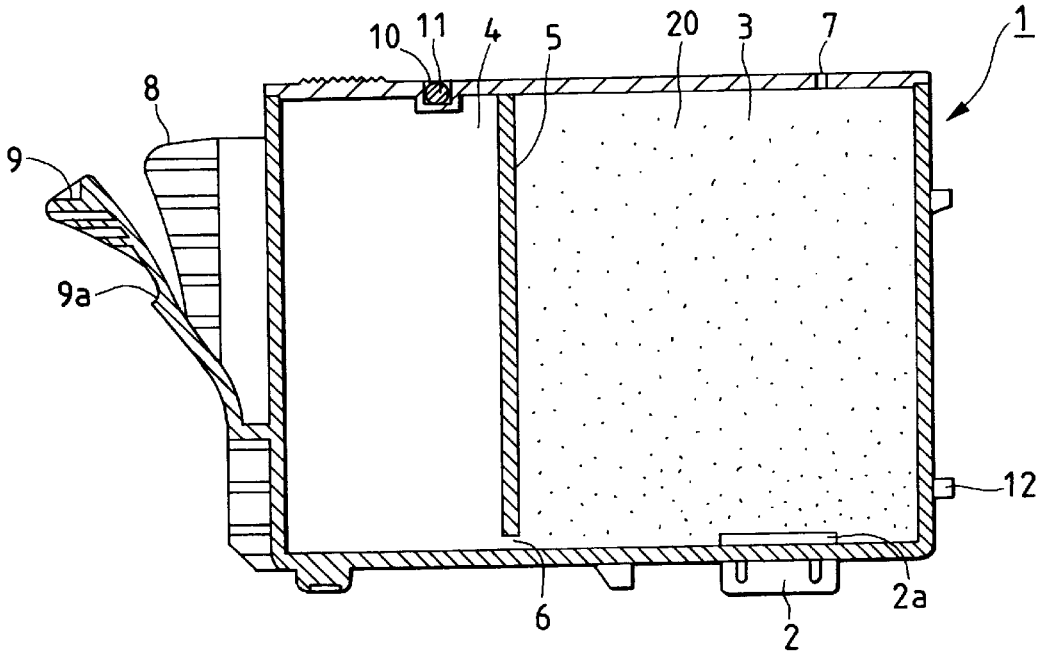
FIG. 5 is a cross-sectional view taken along the line 5—5 of FIG. 4B.
Figure 6:
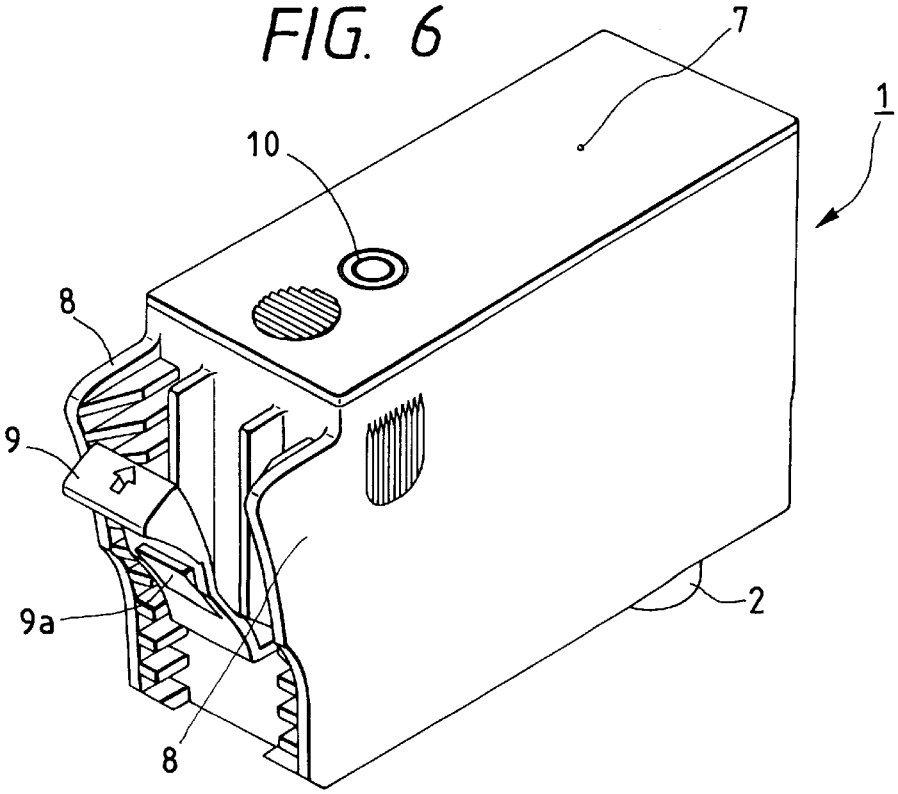
FIG. 6 is a pictorial perspective view of the liquid container according to Embodiment 3.
Figure 7A:
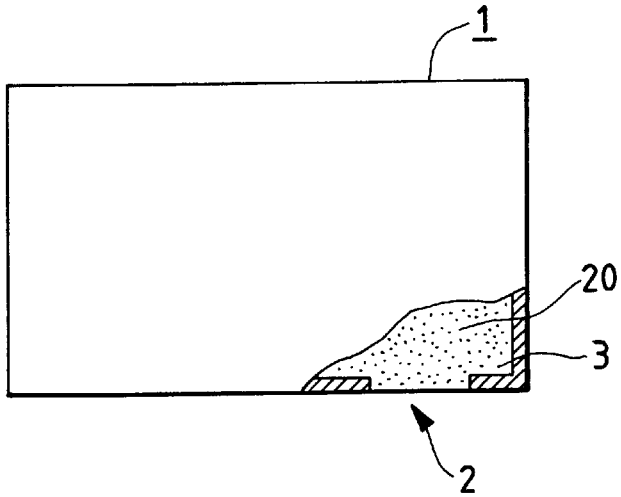
FIGS. 7A, 7B and 7C are schematic views of an example of the liquid container according to the prior art.
Figure 7C:
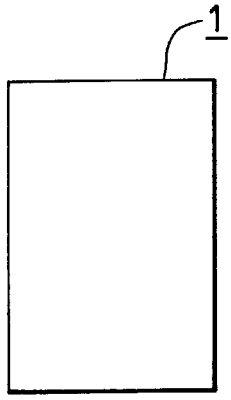
Figure 7B:
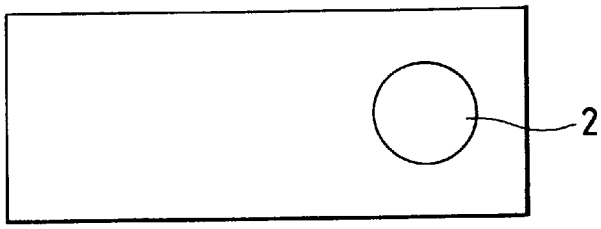

FIGS. 4A to 4F schematically show a liquid container as a liquid preserving region 1 according to Embodiment 3 of the present invention, FIG. 4A being a left side view of the liquid preserving container 1, FIG. 4B being a plan view thereof, FIG. 4C being a front view thereof, FIG. 4D being a right side view thereof, FIG. 4E being a bottom plan view thereof, and FIG. 4F being a rear view. FIG. 5 is a cross-sectional view taken along the line 5—5 of FIG. 4B, and FIG. 6 is a pictorial perspective view of the liquid preserving container shown in FIGS. 4A to 4F and 5.

Referring to FIGS. 4A to 4F, the liquid preserving container 1 is provided with a plurality of liquid supplying ports 2, a positioning member 12 and a latch lever 9 disposed on the sides of the container opposed to each other, and a pair of protective members 8 for sandwiching the latch lever 9 from the opposite sides thereof and protecting it.

Also, as shown in FIG. 5, the interior of the liquid preserving container 1 is divided into a chamber (a second chamber) directly containing therein a liquid 4 contributing to recording and a chamber (a first chamber) containing a liquid holding member (a foamed member) 3 therein by a partition wall 5, and the two chambers communicate with each other through only an opening portion (communicating portion) 6 located at the bottom portion of the container 1. The liquid is supplied by the air and the liquid being exchanged in this communicating portion 6.

The chamber containing the liquid holding member 3 therein is provided with the liquid supplying ports 2 for supplying therethrough the liquid to a recording head portion, not shown, and a vent port (atmosphere communicating portion) 7 for communicating the interior of this chamber with the atmosphere. On the other hand, the chamber containing the liquid 4 therein is provided with a liquid filling port 10 provided to fill the chamber with the liquid 4, and a seal member 11 for sealing the same. Consequently, the chamber containing the liquid 4 therein is a substantially hermetically sealed space except the communicating portion 6.

Thereby, the level of the liquid in the first chamber containing the liquid holding member therein can be stabilized and the state of the negative pressure level for the recording elements can be stabilized. Therefore, stable liquid supply free of the irregularity of characteristic for the respective recording elements becomes possible.

In the present embodiment, as shown in FIG. 4E, two liquid supplying ports 2 are disposed in parallel near the side of the liquid preserving container 1 on which the positioning member 12 is disposed. Also, these two liquid supplying ports 2 are disposed at locations (1) substantially equal to each other in the distance from the communicating portion 6 formed in the container tank by the partition wall 5. Further, the center line (n) of the liquid supplying ports 2 is disposed so as to lie substantially at the center of the center line (m) of the liquid preserving container 1 and the side wall of the liquid preserving container 1.

By adopting such disposition, the flow resistance of the liquid from the communicating portion 6 can be substantially equalized by the two liquid supplying ports 2 and further, the states of the absorbing members in the two liquid supplying ports can be substantially equalized. Accordingly, it becomes possible to achieve well-balanced liquid supply free of irregularity by the two liquid supplying ports 2. As shown in FIG. 5, a fibrous member 2*a* is disposed in each liquid supplying port 2 to thereby improve the supply property of the ink.

The positioning member 12 and the latch lever 9 (which is provided with a pawl 9*a* engageable with a holder) and the protective member 8 for protecting the latch lever 9 are constituent members engageable with a holder, not shown, on which the liquid preserving container 1 is mounted, to thereby fix the liquid preserving container 1 relative to this holder.

In the foregoing description, the liquid includes ink (black, magenta, yellow, cyan, etc.) contributing to recording as well as treating liquid used for image treatment.

As described above, in the present invention, even when a plurality of recording elements are used, only one liquid container is required for a single kind of liquid (ink or treating liquid). Thus, the supplied liquid becomes equal in all recording elements and therefore, the irregularity of the discharging condition for the liquid can be suppressed. Also, the space in which the liquid container in the apparatus is disposed can be saved.

Also, the performance of directing the liquid out of the liquid container can be improved, and stabler liquid supplying performance can be achieved. The fibrous member may be in the form of a fiber bundle or the form of a felt material.

Also, it becomes possible to contain only the liquid in the liquid container and thus, the quantity of ink contained can be improved.

Also, the level of the liquid in the first chamber containing the liquid holding member therein can be stabilized, and the state of the negative pressure level for the recording elements can be stabilized. Therefore, stable liquid supply free of the irregularity of characteristic becomes possible to the respective recording elements.

Also, the distances from the communication opening portion to the liquid supplying portions can be made equal to each other and the flow resistance of the liquid can be uniformized and thus, the supplying properties of the liquid can be adjusted to each other in the two supplying portions.

Also, the plurality of supplying portions in the liquid containing portion are well-balancedly disposed and therefore, the liquid supplying performance can be uniformized irrespective of the supplying portions.

Also, the level of the liquid in the first chamber containing the liquid holding member therein can be stabilized, and the state of the negative pressure level for the recording elements can be stabilized. Therefore, stable liquid supply free of the irregularity of characteristic becomes possible to the respective recording elements. Also, the plurality of supplying portions in the liquid containing portion are well-balancedly disposed and therefore, the liquid supplying performance can be uniformized irrespective of the supplying portions. Further, the disposition space for the liquid container can be saved.

In addition, a simple construction can be intactly adopted without the supply route for the liquid on the recording element side being complicated, and the unnecessary rise of cost can be prevented. Further, stable liquid supply can be achieved, whereby an improvement in printing speed and an improvement in printing density can be achieved well.

Furthermore, according to the present invention, liquid is supplied from a plurality of liquid supplying ports at a time to a plurality of recording elements for discharging the same liquid, with substantially equal flow resistance, and this leads to the following effects.

(1) It becomes possible to improve the printing density as by superposing liquid droplets discharged from the plurality of recording elements upon one another.

(2) Or it becomes possible to improve the actual printing speed as by causing liquid droplets discharged from the plurality of recording elements to be short onto a recording medium with time deviation.

Furthermore, the substances regarding the image design and printing pattern themselves as described above are not the purport of the present invention and therefore need not be described particularly in detail, but yet as long as the liquid preserving container according to the prior art is used, a plurality of liquid preserving containers are required for a plurality of recording elements, while according to the present invention, even if there are a plurality of recording elements, only a single liquid container is sufficient for a single kind of recording liquid and therefore, when an attempt is made to arrange liquid preserving containers in parallel in a recording apparatus, the internal space efficiency is improved and the entire recording apparatus becomes compact, and to a user, it is not necessary to prepare uselessly a number of liquid preserving containers as preliminary ones, and as compared with the liquid preserving container according to the prior art having a single liquid supplying port alone, the liquid preserving container of the present invention is improved in the liquid volume efficiency relative to the configuration of the container and therefore, there is further obtained the advantage of reduced working cost.

What is claimed is:

1. A liquid container for an ink jet apparatus having a plurality of recording elements each provided with plural discharge ports, said liquid container being removably mountable with respect to the plurality of recording elements, said liquid container comprising:

a liquid containing portion containing a single kind of liquid therein;

a plurality of supplying portions provided in a number corresponding to a number of the plurality of recording elements, each for supplying the same liquid from said liquid containing portion out of said liquid container to a corresponding one of said plurality of recording elements, all of which discharge the same liquid; and an atmosphere communicating portion for communicating an interior of said liquid containing portion with the atmosphere and for enabling supply of the liquid from said plurality of supplying portions to the plurality of recording elements of the ink jet apparatus.

2. A liquid container for an ink jet apparatus according to claim 1, further comprising a liquid holding member contained in said liquid containing portion, and a fibrous member disposed in each of said plurality of supplying portions.

3. A liquid container for an ink jet apparatus according to claim 2, wherein black, cyan, magenta or yellow ink is contained in said liquid containing portion.

4. A liquid container for an ink jet apparatus according to claim 2, wherein treating liquid is contained in said liquid containing portion.

5. A liquid container for an ink jet apparatus according to claim 1, wherein said liquid containing portion is divided into a plurality of chambers, which are connected together by a communication opening portion.

6. A liquid container for an ink jet apparatus according to claim 5, wherein black, cyan, magenta or yellow ink is contained in said liquid containing portion.

7. A liquid container for an ink jet apparatus according to claim 5, wherein treating liquid is contained in said liquid containing portion.

8. A liquid container for an ink jet apparatus according to claim 1, wherein said liquid containing portion comprises first and second chambers, wherein the first chamber is provided with a first plurality of said plurality of said supplying portions and with said atmosphere communicating portion and having a liquid holding member container therein, and a wherein the second chamber is a substantially closed space except a communication opening portion provided for communication with said first chamber, and communicating with said first chamber only through said communication opening and containing therein liquid to be supplied to said first chamber.

9. A liquid container for an ink jet apparatus according to claim 8, wherein the number of the first plurality of supplying portions disposed in said first chamber is two, and wherein the two supplying portions are juxtaposed so that distances thereof from said communication opening portion are substantially equal to each other.

10. A liquid container for an ink jet apparatus according to claim 9, wherein respective ones of central positions of said two supplying portions are disposed at locations spaced apart from two side walls constituting said liquid containing portion and adjacent to said two supplying portions, by a distance obtained by substantially quartering the spacing between said two side walls.

11. A liquid container for an ink jet apparatus according to claim 10, wherein black, cyan, magenta or yellow ink is contained in said liquid containing portion.

12. A liquid container for an ink jet apparatus according to claim 10, wherein treating liquid is contained in said liquid containing portion.

13. A liquid container for an ink jet apparatus according to claim 9, wherein black, cyan, magenta or yellow ink is contained in said liquid containing portion.

14. A liquid container for an ink jet apparatus according to claim 9, wherein treating liquid is contained in said liquid containing portion.

15. A liquid container for an ink jet apparatus according to claim 8, wherein black, cyan, magenta or yellow ink is contained in said liquid containing portion.

16. A liquid container for an ink jet apparatus according to claim 8, wherein treating liquid is contained in said liquid containing portion.

17. A liquid container for an ink jet apparatus according to claim 1, wherein black, cyan, magenta or yellow ink is contained in said liquid container containing portion.

18. A liquid container for an ink jet apparatus according to claim 1, wherein treating liquid is contained in said liquid containing portion.

19. A liquid container for an ink jet apparatus having a plurality of recording elements each provided with plural discharge ports, said liquid container being removably mounted with respect to the plurality of recording elements, said liquid container comprising:

a liquid containing portion containing a single kind of liquid therein;

a plurality of supplying portions provided in a number corresponding to a number of the plurality of recording elements, each for supplying the same liquid from said liquid containing portion out of said liquid container to a corresponding one of said plurality of recording elements, all of which discharge the same liquid; and an atmosphere communicating portion for communicating an interior of said liquid containing portion with the atmosphere and for enabling supply of the liquid from said plurality of supplying portions to the plurality of recording elements of the ink jet apparatus, wherein said liquid containing portion comprises first and second chambers, wherein the first chamber is provided with a first plurality of said plurality of supplying portions and is further provided with said atmosphere communicating portion and a liquid holding member, and wherein the second chamber is a substantially closed space except a communication opening provided for communication with said first chamber, the second chamber communicating with said first chamber only through said communication opening and containing therein liquid to be supplied to said first chamber, and wherein the number of said first plurality of supplying portions disposed in said first chamber is two, said two supplying portions being juxtaposed so that distances thereof from said communication opening portion are substantially equal to each other.

20. A liquid container for an ink jet apparatus according to claim 19, wherein respective ones of the central positions of said two supplying portions are disposed at locations spaced apart from two side walls constituting said liquid containing portion and adjacent to said two supplying portions, by a distance obtained by substantially quartering the spacing between said side walls.

21. A liquid container for an ink jet apparatus according to claim 20, wherein a fibrous member is disposed in each of said supplying portions.

22. A liquid container for an ink jet apparatus according to claim 20, wherein black, cyan or magenta ink is contained in said liquid containing portion.

23. A liquid container for an ink jet apparatus according to claim 20, wherein treating liquid is contained in said liquid containing portion.

24. A liquid container for an ink jet apparatus according to claim 19, wherein a fibrous member is disposed in each of said supplying portions.

25. A liquid container for an ink jet apparatus according to claim 19, wherein black, cyan or magenta ink is contained in said liquid containing portion.

26. A liquid container for an ink jet apparatus according to claim 19, wherein treating liquid is contained in said liquid containing portion.

27. A liquid container for an ink jet apparatus according to claim 19, wherein the number of recording elements for discharging said single kind of liquid is two.

28. A liquid container for an ink jet apparatus having a plurality of recording elements, said liquid container being removably mounted with respect to the plurality of recording elements, said liquid container comprising:

a liquid containing portion containing a single kind of liquid therein;

a plurality of supplying portions provided in a number corresponding to a number of the plurality of recording elements, projecting outwardly from said liquid containing portion, each supplying portion for supplying the same liquid from said liquid containing portion out of said liquid container to a corresponding one of said plurality of recording elements, all of which discharge the same liquid; and an atmosphere communicating portion for communicating an interior of said liquid containing portion with the atmosphere and for enabling supply of the liquid from said plurality of supplying portions to the plurality of recording elements of the ink jet apparatus, and for providing a negative pressure source;

an absorbing member disposed in said liquid containing portion; and a fibrous material in contact with said absorbing member and arranged in each of said plurality of supplying portions at least in a vicinity of outward projections thereof, wherein said liquid containing portion comprises first and second chambers, wherein the first chamber is provided with a first plurality of said plurality of supplying portions and is further provided with said atmosphere communicating portion and said absorbing member, and wherein the second chamber is a substantially closed space except a communication opening provided for communication with said first chamber, the second chamber communicating with said first chamber only through said communication opening and containing therein liquid to be supplied to said first chamber, and wherein the number of said first plurality of supplying portions disposed in said first chamber is two, said two supplying portions being juxtaposed so that distances thereof from said communication opening portion are substantially equal to each other.

* * * * *

UNITED STATES PATENT AND TRADEMARK OFFICE

CERTIFICATE OF CORRECTION

PATENT NO. : 6,203,148 B1
DATED : March 20, 2001
INVENTOR(S) : Hajime Kishida

It is certified that error appears in the above-identified patent and that said Letters Patent is hereby corrected as shown below:

Column 1,
Line 51, "need" should read -- needs to --.

Column 6,
Line 59, "are" should read -- is --.

Column 7,
Line 57, "are" should read -- is --.

Column 8,
Line 49, "a" (1st occurrence) should be deleted.

Column 9,
Line 21, "container" should be deleted.

Signed and Sealed this

Fifth Day of March, 2002

*Attest:*

*Attesting Officer*

JAMES E. ROGAN
*Director of the United States Patent and Trademark Office*